US005975783A

United States Patent [19]

HU

[11] Patent Number: 5,975,783

[45] Date of Patent: Nov. 2, 1999

[54] PEN CAP WITH PRESSURE RELIEF MEANS

[75] Inventor: Cho-Kai HU, Shin-Tien, Taiwan

[73] Assignee: Pro Eton Corporation, Taipei, Taiwan

[21] Appl. No.: 09/136,284

[22] Filed: Aug. 19, 1998

[51] Int. Cl.[6] ..... B43K 23/12

[52] U.S. Cl. ..... 401/245; 401/202; 401/213; 401/247

[58] Field of Search ..... 401/245, 247, 401/246, 202, 213

[56] References Cited

U.S. PATENT DOCUMENTS

| | | | |
|---|---|---|---|
| 4,380,403 | 4/1983 | Endres et al. | 401/247 X |
| 4,627,757 | 12/1986 | Manusch et al. | 401/247 X |
| 4,844,642 | 7/1989 | Inaba et al. | 401/247 X |
| 5,127,754 | 7/1992 | Mase | 401/213 X |
| 5,441,356 | 8/1995 | Cho | 401/247 |

*Primary Examiner*—Henry J. Recla
*Assistant Examiner*—Kathleen J. Prunner
*Attorney, Agent, or Firm*—Bacon & Thomas

[57] ABSTRACT

A pen cap for closing on a ball-point pen to prevent ink leakage, the pen cap including a cap body, a sealing cap covered on the cap body, and a ball valve mounted inside the cap body within the sealing cap and moved between inside ribs in the cap body and inside ribs in the sealing cap. Closing the pen cap on the pen causes excessive air to pass through an air passage formed by gaps among the inside ribs to the outside of the pen cap via an exhaust hole on the sealing cap, and the air passage is closed when the writing tip of the pen is engaged into a tapered hole on one cylindrical rod projecting from the ball valve.

4 Claims, 4 Drawing Sheets

PEN CAP WITH PRESSURE RELIEF MEANS

BACKGROUND OF THE INVENTION

Field of the Invention

The present invention relates to a pen cap for a ball-point pen, and more particularly to a pen cap with pressure relief means which enables excessive air pressure to be released when the cap body of the pen cap is closed on the pen and, which prevents an ink leakage when completely closed on the pen.

When a pen cap is closed on a ball-point pen, inside air cannot escape out of the pen cap, therefore the pressure of air inside the pen cap is greatly increased when the pen cap is fully closed on the pen, causing ink to leak out of the pen. In order to eliminate this problem, there is provided a pen cap with pressure relief means. This structure of pen cap, as shown in FIG. 1, comprises a cap body 10 having an inner barrel 101 and an exhaust hole 102 at the center of the closed outer end of the inner barrel 101, a spring 20 mounted within the inner barrel 101, a socket 40 mounted within the inner barrel 101 and supported on the spring 20, and a rubber gasket 30 fastened to the socket 40 at one end. When the pen cap 10 is closed on the pen, excessive air pressure is released out of the pen cap through the exhaust hole 102. When the pen cap 10 and the pen are firmly fastened together, the writing tip of the pen is stopped at the rubber gasket 30 and retained inside the socket 40 in an air tight manner. This structure of pen cap eliminates an ink leakage. However, this structure of pen cap is expensive to manufacture, and complicated to assemble.

SUMMARY OF THE INVENTION

It is one object of the present invention to provide a pen cap for a ball-point pen which effectively eliminates an ink leakage when closed on the pen. It is another object of the present invention to provide a pen cap for a ball-point pen which has a simple structure, and is inexpensive to manufacture. A pen cap according to the preferred embodiment of the present invention comprises a cap body, a sealing cap covered on the cap body, and a ball valve mounted inside the cap body within the sealing cap and moved between inside ribs in the cap body and inside ribs in the sealing cap. When closing the pen cap on the pen, excessive air is forced to pass through gaps among the inside ribs to the outside of the pen cap via an exhaust hole on the sealing cap, and the air passage is closed when the writing tip of the pen is engaged into a tapered hole on one cylindrical rod at the ball valve.

DETAILED DESCRIPTION OF THE PREFERRED EMBODIMENT

Figure 1:
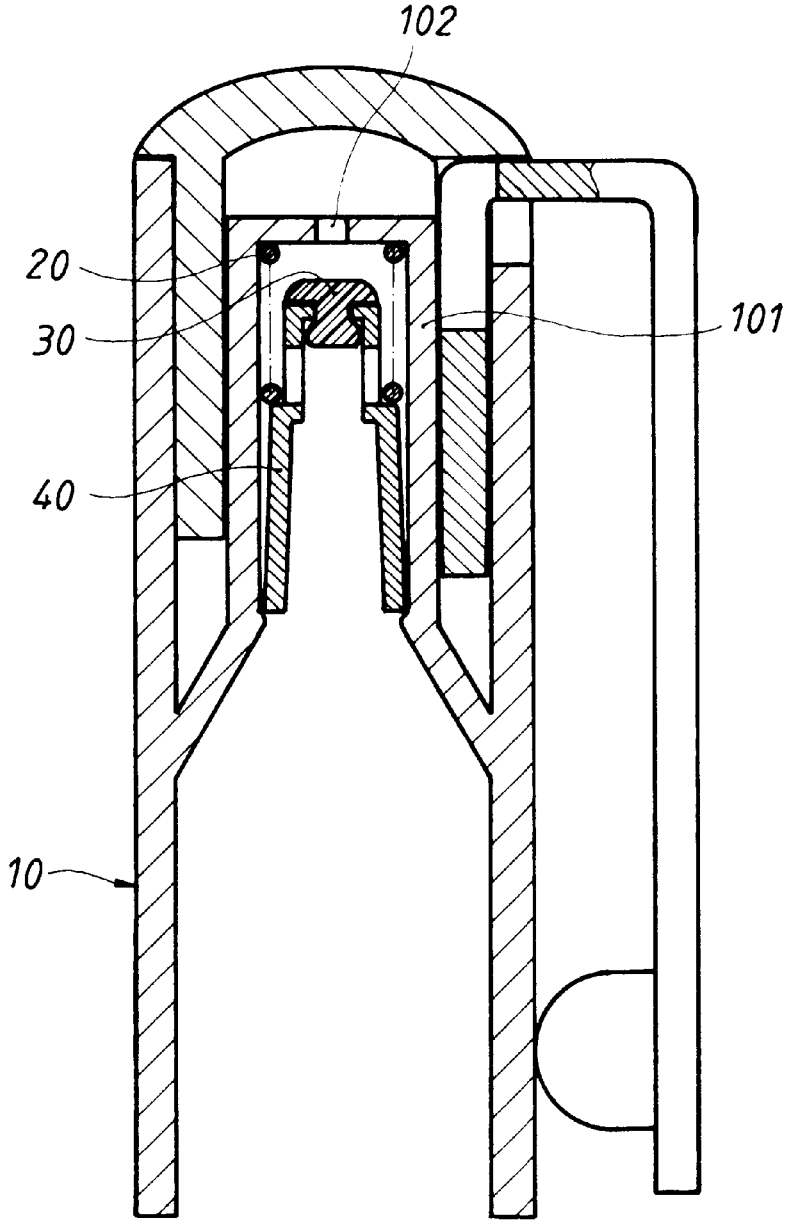
PRIOR ART FIG. 1
FIG. 1 is a sectional view of a pen cap according to the prior art.
Figure 2:
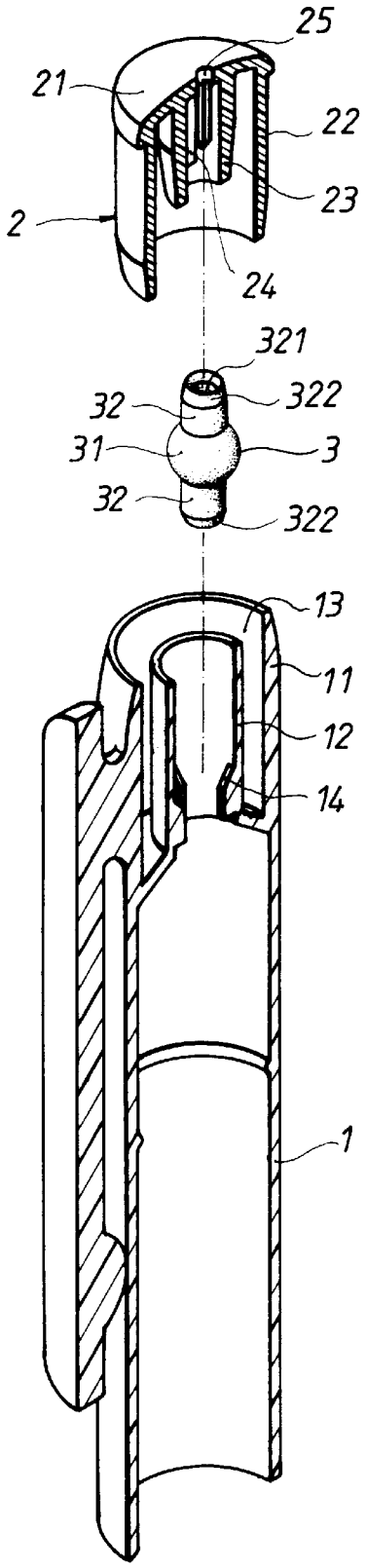
FIG. 2 is an exploded view of a pen cap according to the present invention.

Referring to FIG. 2, a pen cap in accordance with the present invention is generally comprised of a cap body 1, a sealing cap 2, and a ball valve 3.

The cap body 1 is a tubular member comprising an outer cylinder 11, an inner cylinder 12 suspended inside the outer cylinder 11 at one end, an annular open chamber 13 defined between the inner cylinder 12 and the outer cylinder 11, and a plurality of inside ribs 14 raised from the inside wall of the inner cylinder 12.

The sealing cap 2 comprises a flat cap head 21, an outer cylinder 22 perpendicularly extended from the flat cap head 21 at one side, an inner cylinder 23 perpendicularly extended from the flat cap head 21 within the outer cylinder 22, a plurality of inside ribs 24 raised from the inside wall of the inner cylinder 23, and an exhaust hole 25 at the center of the flap cap head 21 in communication with the inside space of the inner cylinder 23.

The ball valve 3 is molded from elastic material, for example rubber, comprising a valve body 31, two cylindrical rods 32 respectively extended from the periphery of the valve body 31 in reversed directions. The cylindrical rods 32 each have a tapered hole 321 at the end and a thin flange 322 around the tapered hole 321.

Referring to FIGS. from 3 through 7 and FIG. 2 again, the ball valve 3 is inserted into the inner cylinder 12, permitting the valve body 31 to be supported on the inside ribs 14, then the sealing cap 2 is covered on the cap body 1 by inserting the outer cylinder 22 of the sealing cap 2 into the annular open chamber 13 of the cap body 1 and the inner cylinder 23 of the sealing cap 2 into the inner cylinder 12 of the cap body 1, permitting the inside ribs 24 of the sealing cap 2 to be stopped above the valve body 31 of the all valve 3.

Figure 3:
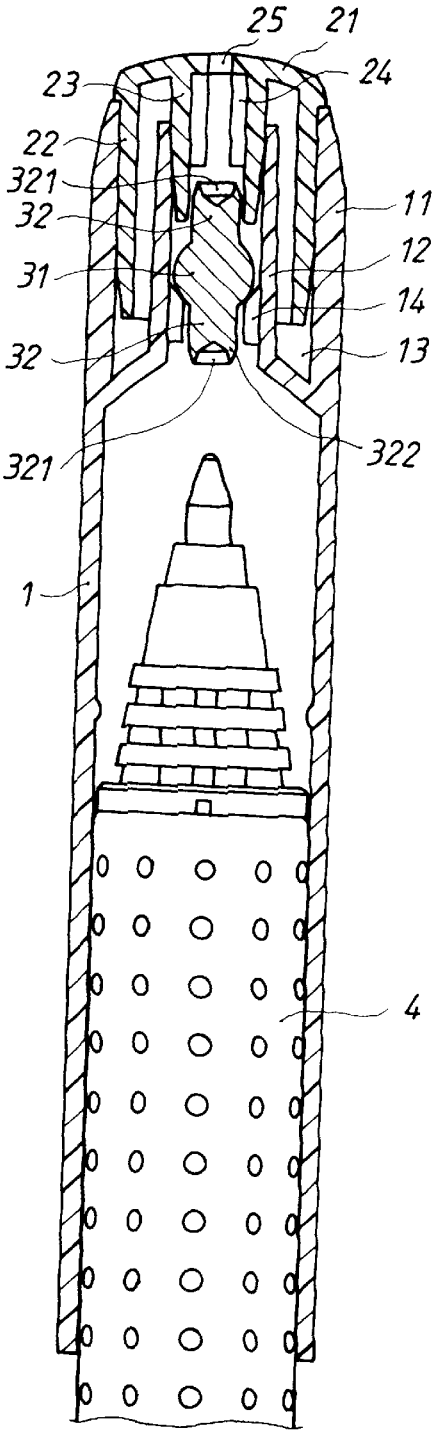
FIG. 3 is a sectional view showing the pen cap attached to the pen according to the present invention.
Figure 4:
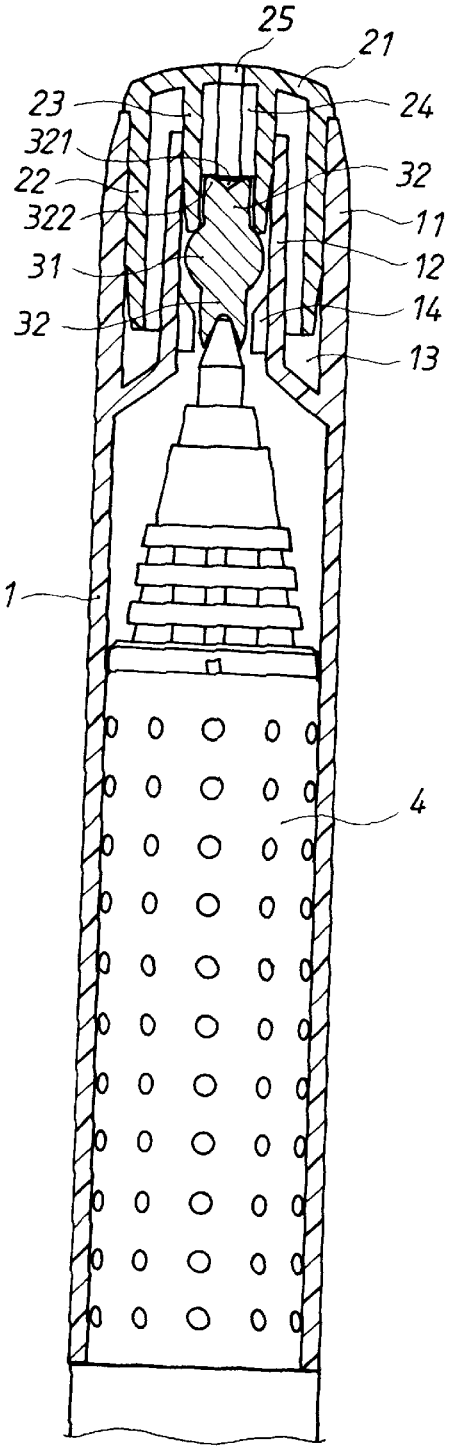
FIG. 4 is similar to FIG. 3 but showing the pen cap fully closed, the writing tip of the pen engaged into the tapered hole on one cylindrical rod of the ball valve.

When the cap body 1 is closed on the pen 4, inside air is allowed to pass from the inside of the cap body 1 through gaps among the inside ribs 14 of the cap body 1 and gaps among the inside ribs 24 of the sealing cap 2 to the outside of the pen cap via the exhaust hole 25 (see FIG. 3). When the cap body 1 and the pen 4 are firmly fastened together and the writing tip of the pen 4 is inserted into the tapered hole 321 of the bottom cylindrical rod 32 of the ball valve 3, the pen 4 is sealed up, and therefore no ink leakage occurs.

Figure 5:
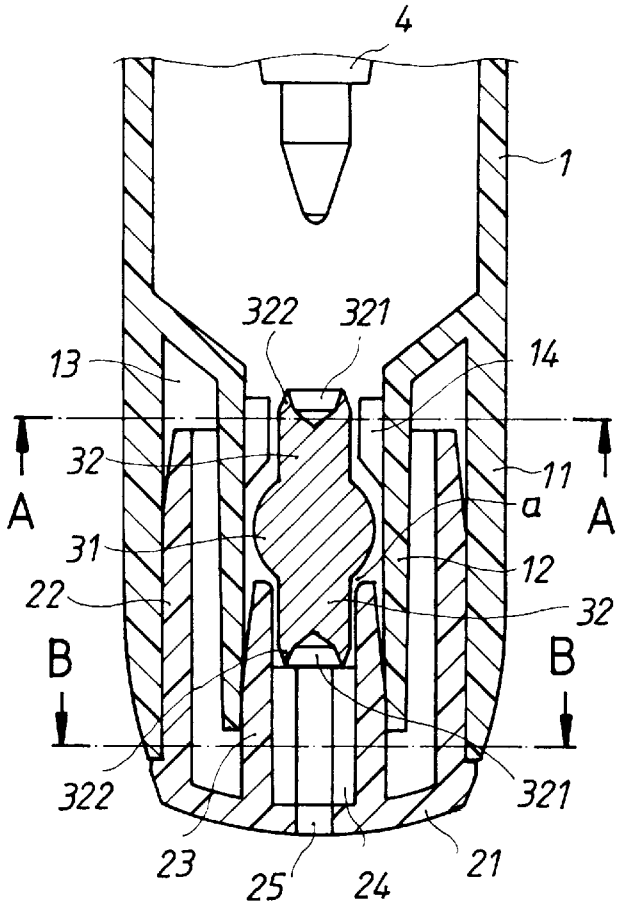
FIG. 5 shows the pen turned upside down and the pen cap closed on the pen from the bottom side according to the present invention.
Figure 6:
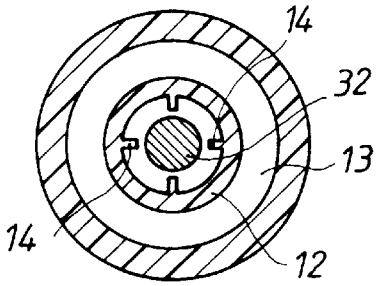
FIG. 6 is a sectional view taken along line A—A of FIG. 5.
Figure 7:
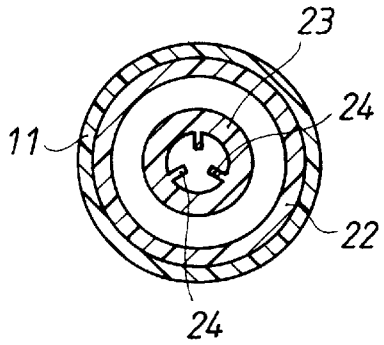
FIG. 7 is a sectional view taken along line B—B of FIG. 5.

If the pen 4 is turned upside down and the pen cap is closed on the pen 4 from the bottom side (see FIG. 5), the inside ribs 24 of the sealing cap 2 are stopped against the thin flange 322 of one cylindrical rod 32 of the ball valve 3, and a gap "a" is maintained between the inner cylinder 23 of the sealing cap 2 and the valve body 31 of the ball valve 3, enabling air pressure to pass to the outside through the exhaust hole 25 (see FIG. 5). When the pen cap is continuously pushed inwards and the writing tip of the pen 4 is inserted into the tapered hole 321 of one cylindrical rod 32 of the ball valve 3, the pen 4 is sealed up to eliminate an ink leakage.

What the invention claimed is:

1. A pen cap for closing on a pen, comprising:

a cap body, said cap body comprising an outer cylinder, an inner cylinder suspended inside the outer cylinder of said cap body at one end, an annular open chamber defined between the inner cylinder and the outer cylinder of said cap body, and a plurality of inside ribs raised from the inner cylinder of said cap body on the inside;

a sealing cap closed on said cap body, said sealing cap comprising a flat cap head stopped outside the outer cylinder of said cap body at one end, an outer cylinder perpendicularly extended from said flat cap head at one side and inserted into said annular open chamber inside said cap body, an inner cylinder perpendicularly extended from said flat cap head within the outer cylinder of said sealing cap and inserted into the inner cylinder of said cap body, a plurality of inside ribs raised from the inner cylinder of said sealing cap on the inside, and an exhaust hole at the center of said flap cap head in communication with the inside space of the inner cylinder of said sealing cap; and a ball valve mounted inside the inner cylinder of said cap body, said ball valve comprising a valve body with said ball valve being disposed between the inside ribs of said cap body and the inside ribs of said sealing cap, a first cylindrical rod and a second cylindrical rod respectively extended from the periphery of said valve body in reversed directions;

wherein when the cap body of the pen cap is closed on the pen, the writing tip of the pen is stopped at the first cylindrical rod of said ball valve, and the second cylindrical rod of said ball valve is stopped at the inside ribs of said sealing cap, enabling the pen to be maintained in an air tight condition.

2. The pen cap of claim 1 wherein said ball valve is molded from rubber.

3. The pen cap of claim 1 wherein said first cylindrical rod and said second cylindrical rod each have a tapered hole at the end and a thin flange around the tapered hole.

4. The pen cap of claim 1 wherein the outer diameter of the cylindrical rods of said ball valve is smaller than the inner diameter of the inner cylinder of said sealing cap.

* * * * *